US009607755B2

(12) United States Patent
Pennander

(10) Patent No.: US 9,607,755 B2
(45) Date of Patent: Mar. 28, 2017

(54) INDUCTOR AND INDUCTOR CORE

(71) Applicant: HOGANAS AB (PUBL), Hoganas (SE)

(72) Inventor: Lars-Olov Pennander, Helsingborg (SE)

(73) Assignee: HOGANAS AB (PUBL), Hoganas (SE)

( * ) Notice: Subject to any disclaimer, the term of this patent is extended or adjusted under 35 U.S.C. 154(b) by 0 days.

(21) Appl. No.: 14/654,248

(22) PCT Filed: Dec. 10, 2013

(86) PCT No.: PCT/EP2013/076074
§ 371 (c)(1),
(2) Date: Jun. 19, 2015

(87) PCT Pub. No.: WO2014/095486
PCT Pub. Date: Jun. 26, 2014

(65) Prior Publication Data

US 2015/0348698 A1 Dec. 3, 2015

(30) Foreign Application Priority Data

Dec. 19, 2012 (EP) ..... 12197962

(51) Int. Cl.
*H01F 27/02* (2006.01)
*H01F 21/04* (2006.01)
(Continued)

(52) U.S. Cl.
CPC ..... *H01F 27/306* (2013.01); *H01F 17/043* (2013.01); *H01F 27/255* (2013.01); *H01F 27/263* (2013.01)

(58) Field of Classification Search
CPC ..... H01F 27/30
(Continued)

(56) References Cited

U.S. PATENT DOCUMENTS 4,553,123 A 11/1985 Tamada et al.
6,348,265 B1 2/2002 Jansson et al.
(Continued)

FOREIGN PATENT DOCUMENTS

GB 633364 12/1949

OTHER PUBLICATIONS

International Search Report (PCT/ISA/210) mailed on Feb. 12, 2014, by the European Patent Office as the International Searching Authority for International Application No. PCT/EP2013/076074.
(Continued)

*Primary Examiner* — Mangtin Lian
*Assistant Examiner* — Ronald Hinson
(74) *Attorney, Agent, or Firm* — Buchanan Ingersoll & Rooney P.C.

(57) ABSTRACT

The inductor core has a higher magnetic permeability than air, and includes an endless channel adapted for containing an inductor winding, where the inductor core extends along a first axis A, and the inductor winding extends completely around the first axis A of the inductor core in such a way that the inductor winding has a number of discrete positions or first sections where it extends in a direction being perpendicular to the first axis A of the inductor core, and wherein the inductor winding, between the discrete positions or first sections, has second sections where it extends at least partly along the first axis A.

12 Claims, 2 Drawing Sheets

(51) Int. Cl.

| | |
|---|---|
| ***H01F 17/04*** | (2006.01) |
| ***H01F 27/30*** | (2006.01) |
| ***H01F 27/255*** | (2006.01) |
| ***H01F 27/26*** | (2006.01) |

(58) Field of Classification Search
USPC ..... 336/90
See application file for complete search history.

(56) References Cited

U.S. PATENT DOCUMENTS

2012/0081204 A1* 4/2012 Garrity ..... H01F 27/2847
336/221
2012/0319812 A1* 12/2012 Shang ..... H01F 27/306
336/233

OTHER PUBLICATIONS

Written Opinion (PCT/ISA/237) mailed on Feb. 12, 2014, by the European Patent Office as the International Searching Authority for International Application No. PCT/EP2013/076074.

* cited by examiner

INDUCTOR AND INDUCTOR CORE

TECHNICAL FIELD

The present invention relates to inductors and inductor cores.

BACKGROUND

Inductors are used in a wide array of applications such as signal processing, noise filtering, power generation, electrical transmission systems etc. In order to provide more compact and more efficient inductors, the electrically conducting winding of the inductor may be arranged around an elongated magnetically conducting core, i.e. an inductor core. An inductor core is preferably made of a material presenting a higher permeability than air wherein the inductor core may enable an inductor of increased inductance.

Inductor cores are available in a large variety of designs and materials, each having their specific advantages and disadvantages. However, due to the ever increasing demand for inductors in different applications requiring less space there is still a need for inductors and inductor cores having a compact and efficient design and thereby being usable in a wide range of applications.

SUMMARY

According to a first aspect, disclosed herein are embodiments of an inductor core having a higher magnetic permeability than air, and comprising an endless channel adapted for containing an inductor winding having at least one conductor wound in one or more loops, and where the inductor core extends along a first axis, and the endless channel extends completely around the first axis of the inductor core in such a way that the endless channel, and thereby the inductor winding, has a number of discrete positions or first sections where it extends in a direction being perpendicular to the first axis of the inductor core, and wherein the endless channel, and thereby the inductor winding, between the discrete positions or first sections, has second sections where it extends at least partly along the first axis.

The length of one conductor loop in the winding is thereby relatively long compared with the inductor core volume, making it possible to obtain an inductor providing specific inductance characteristics, but requiring less space compared to prior art inductors, e.g. inductors having a potcore design.

In the following a number of embodiments are disclosed, providing the option of designing even more compact inductors or inductor cores.

The endless channel of the inductor core, and thereby the inductor winding, may at least at one position or section, extend in a direction being parallel to the first axis of the inductor core.

The inductor core may be surrounding the endless channel at least along a section of one or more of the second section.

The inductor core may furthermore completely encapsulate the inductor winding.

In a preferred embodiment of the invention, by which the inductor core is especially easy to produce by molding, casting, forging or sintering, the inductor core comprises a first and a second inductor core part, each having a first number of abutment surfaces being arranged substantially parallel to the first axis, and a second number of abutment surfaces being arranged transverse to the first axis, and where the first number of abutment surfaces on the first and the second inductor core part are complementarily shaped, so that the inductor core parts can be assembled by sliding the first number of abutment surfaces of the first inductor core part along the first axis, on the first number of abutment surfaces on the second inductor core part, and until the second number of abutment surfaces on the first inductor part abuts the second abutment surfaces on the second inductor part, in which position the two inductor core parts forms a channel for enclosing at least the second sections of the endless channel.

In a further preferred embodiment the inductor core is designed such that the two inductor core parts have the same shape and size.

Embodiments of the inductor core described herein are well-suited for production by Powder Metallurgy (P/M) production methods. Accordingly, the inductor core parts are in a preferred embodiment made of a soft magnetic powder material in some embodiments, the inductor core is made from a soft magnetic material such as compacted soft magnetic powder, thereby simplifying the manufacturing of the inductor core components and providing an effective three-dimensional flux path in the soft magnetic material allowing e.g. radial, axial and circumferential flux path components in a inductor core. Here and in the following, the term soft magnetic is intended to refer to a material property of a material that can be magnetized but does not tend to stay magnetized, when the magnetising field is removed. Generally a material may be described as soft magnetic when its coercivity is no larger than 1 kA/m (see e.g. "Introduction to Magnetism and Magnetic materials", David Jiles, First Edition 1991 ISBN 0 412 38630 5 (HB), page 74).

The term "soft magnetic composites" (SMC) as used herein is intended to refer to pressed/compacted and heat-treated metal powder components with three-dimensional (3D) magnetic properties. SMC components are typically composed of surface-insulated iron powder particles that are compacted to form uniform isotropic components that may have complex shapes in a single step.

The soft magnetic powder may e.g. be a soft magnetic Iron powder or powder containing Co or Ni or alloys containing parts of the same. The soft magnetic powder may be a substantially pure water atomised iron powder or a sponge iron powder having irregular shaped particles which have been coated with an electrical insulation. In this context the term "substantially pure" means that the powder should be substantially free from inclusions and that the amount of the impurities such as O, C and N should be kept at a minimum. The weight average particle sizes may generally be below 300 μm and above 10 μm.

However, any soft magnetic metal powder or metal alloy powder may be used as long as the soft magnetic properties are sufficient and that the powder is suitable for die compaction.

The electrical insulation of the powder particles may be made of an inorganic material. Especially suitable are the type of insulation disclosed in U.S. Pat. No. 6,348,265 (which is hereby incorporated by reference), which concerns particles of a base powder consisting of essentially pure iron having an insulating oxygen- and phosphorus-containing barrier. Powders having insulated particles are available as Somaloy® 500, Somaloy® 550 or Somaloy® 700 available from Höganas AB, Sweden.

BRIEF DESCRIPTION OF THE DRAWINGS

Embodiments of the various aspects disclosed herein, as well as additional objects, features and advantages of the present inventive concept, will be described in more detail in the following illustrative and non-limiting description of embodiments of the aspects disclosed herein with reference to the appended drawings, where like reference numerals refer to like elements unless stated otherwise, wherein.

DETAILED DESCRIPTION OF PREFERRED EMBODIMENTS

Figure 1:
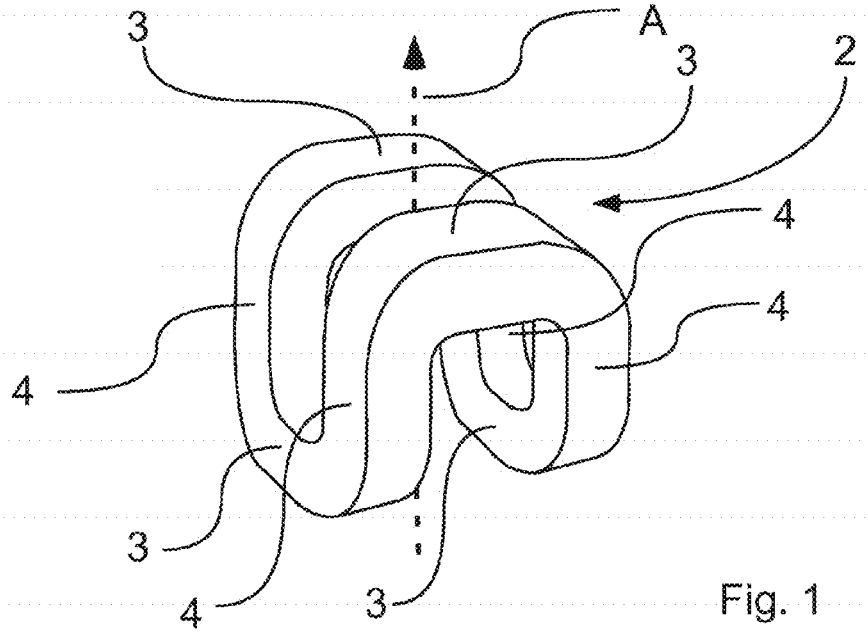
FIG. 1 is a perspective view of an inductor winding to be used in an embodiment of an inductor.

FIG. 1 is a perspective view of an inductor winding 2 to be used in an embodiment of an inductor 1. In this relation the drawing only shows an outline of such an inductor winding 2. It is, however, evident that the inductor winding 2 may comprise one or more electric conductors being wound in one or more loops within the outline shown in FIG. 1. The inductor winding 2 may also, apart from the conductor, comprise other elements e.g. for supporting the conductor windings, and it is evident that such elements may generally extend within the outline of the inductor winding 2. Furthermore, the inductor winding 2 may generally comprise at least two taps for connecting the conductor loops to e.g. an external electric circuitry, and even though such taps are not shown in the figures, it is evident that they may extend away from the inductor winding 2 and to the outside of the fully assembled inductor 1 as shown in FIG. 4.

The outline of the inductor winding 2 shown in FIG. 1 therefore also shows an example of the minimum space that the inductor core 1 must provide in order to contain the inductor winding 2, and in this respect it shows an example of a suitable shape of an endless channel that is to be arranged in the inductor core 1.

The outline of the inductor winding 2 and/or the endless channel that is to be arranged in the inductor core 1 has, in this embodiment, four first sections 3 where the inductor winding 2 or endless channel extends in a direction perpendicular to the first axis A and four second sections 4 where the inductor winding or endless channel extends at least partly along the first axis A. It is however evident that differing embodiments may be suggested within the scope of the invention, e.g. where the inductor winding or the endless channel has more than four sections of the first and/or second kind, and that it is possible to design inductors having first and second sections with e.g. different lengths in order to obtain inductors with different inductance characteristics.

Figure 2:
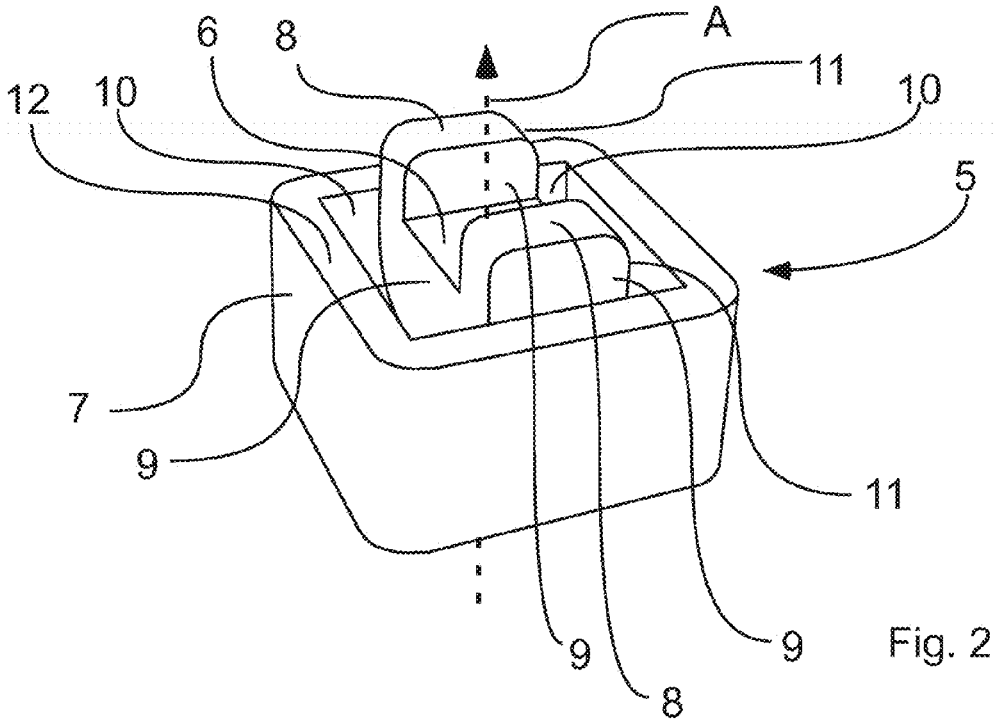
FIG. 2 is a perspective view of one part of an inductor core according to an embodiment of the present invention.
Figure 3:
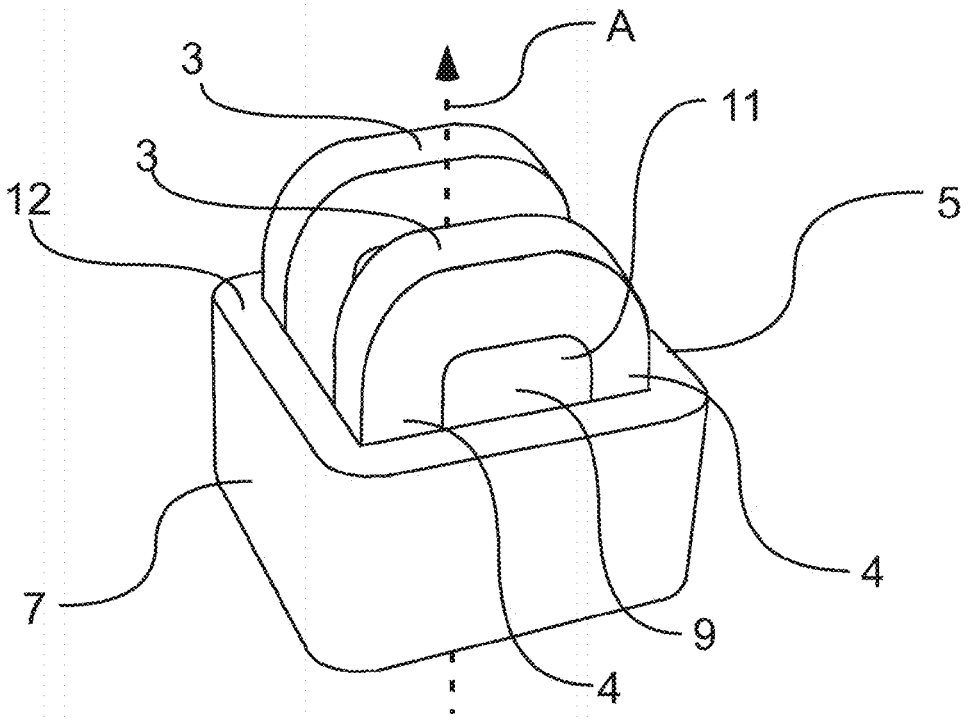
FIG. 3 is a perspective view showing the inductor winding according to FIG. 1 being arranged in the inductor core part according to FIG. 2.
Figure 4:
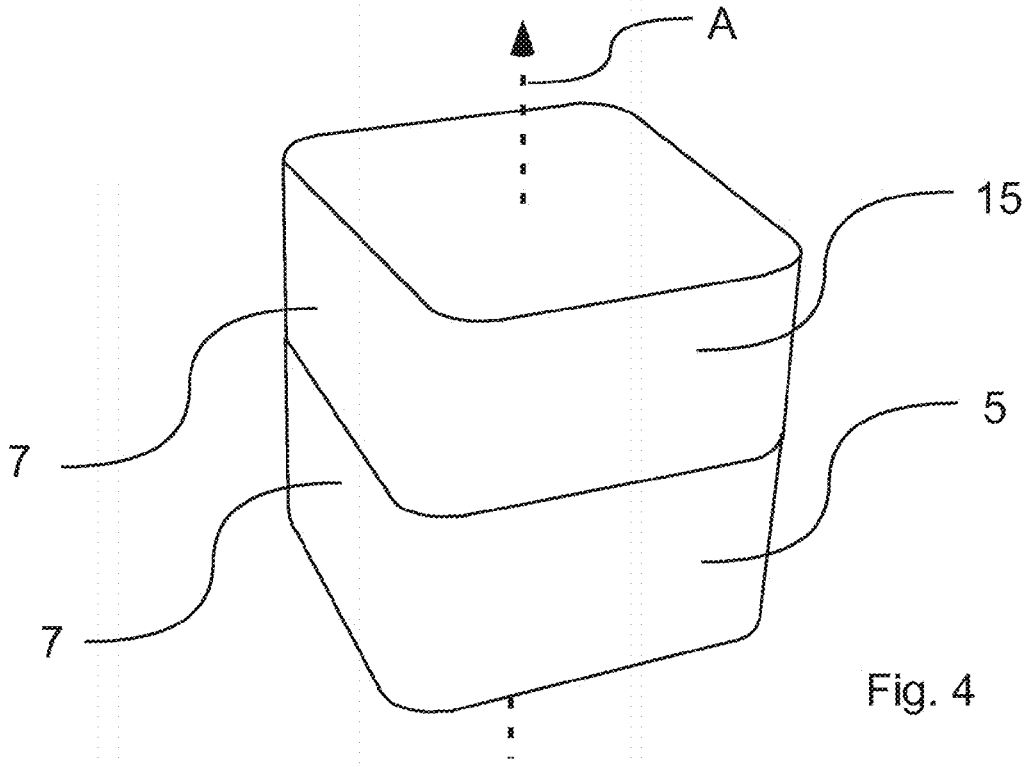
FIG. 4 is a perspective view of a complete assembly of an inductor according to an embodiment of the invention.

In this relation FIG. 2 shows a first inductor core part 5, and the inductor shown in FIG. 4 comprises two such inductor core parts 5 and 15, where the first inductor core part 5 is oriented as shown on FIG. 2, and the second inductor core part 15 is identical to the first inductor core part 5, but turned upside down and rotated 90 degrees around the first axis A. In this position the projections 11 extending from each of the first and the second inductor core parts 5 and 15 will extend partially into the channel parts 10 of the other inductor core part when the two inductor core parts are assembled as shown in FIG. 4.

The first and the second inductor core part each comprises an outer core member 7 formed as a square shaped cup and has an inner core member 6 extending along the first axis A from the bottom of the outer core member 7. The outer core member 7 and the inner core member 6 has a number of first abutment surfaces 9 that extend substantially parallel to the first axis A, and allowing that the inductor winding 2 as shown in FIG. 1 can be placed in the channel parts 10 arranged in the first inductor core part 5, and that the two inductor core parts 5 and 15 can be assembled to form the complete inductor core 1 shown in FIG. 4. In this position the second abutment surfaces 12 on the first inductor core part 5 touch the corresponding second abutment surfaces on the second inductor core part 15.

Thereby the two inductor core parts 5 and 15 are, except from e.g. the taps that may extend from the inductor winding 2 and through the outer core member, completely enclose the inductor core winding 2, and the complete assembly 1 as shown in FIG. 4 forms a kind of a potcore inductor 1. The conductor loops in the inductor winding 2 are very long with respect to the outer dimensions of the inductor 1, thereby providing an inductor 1 having a relatively high inductance.

It will be appreciated that other embodiments of an inductor core may comprise two or more inductor core components of different shapes. For example, only one of the core parts may comprise an inner core member section which then may be sufficiently long so as to axially extend all the way to the bottom of the other inductor core part in the assembled inductor core 1. Alternatively or additionally, the projections of the two components may have different shapes and sizes.

The two inductor core parts 5 and 15 are adapted to be assembled axially aligned and with their respective inner core members facing each other and such that the projections extend into the gaps formed by the projections of the other component.

The inner core members may touch each other with their respective abutments surfaces 12 in the assembled indictor core so as to form an inner core member extending all the way between the two inductor core parts 5 and 15 respectively. In some embodiments, however, the inner core members may define an axial flux barrier, e.g. in the form of an axially extending gap between them and/or in the form of a part of one or both inner core member sections comprising a material of lower permeability.

The inductor core parts may each be made of compacted magnetic powder material. The material may be soft magnetic powder. The material may be ferrite powder. The material may be surface-insulated soft magnetic powder, e.g. comprising iron particles provided with an electrically insulating coating. The resistivity of the material may be such that eddy currents are substantially suppressed. As a more specific example, the material may be a soft magnetic powder, e.g. from the product family Somaloy (e.g. Somaloy (R) 110i, Somaloy(R) 130i or Somaly(R) 700HR) from Hoeganaes AB, S-263 83 Hoeganaes, Sweden.

The soft magnetic powder may be filled into a die and compacted. The material may then be heat treated, e.g. by sintering (for powder materials such as ferrite powder) or at a relatively low temperature so as not to destroy an insulating layer between the powder particles (for soft magnetic composites). During the compaction process a pressure may be applied in a direction corresponding to the axial direction of the respective member. In the radial and circumferential directions the dimension of the components are defined by the cavity walls of the mold. Each component may thus be manufactured using uniaxial compaction with a tighter tolerance in the radial and circumferential directions than in the axial direction.

Alternatively, the inductor core components may be made from a different material of a sufficiently high permeability, higher than the permeability of air, and/or assembled from a plurality of individual pieces rather than formed in a single piece.

Although some embodiments have been described and shown in detail, the invention is not restricted to them, but may also be embodied in other ways within the scope of the subject matter defined in the following claims. In particular, it is to be understood that other embodiments may be utilized, and that structural and functional modifications may be made without departing from the scope of the present invention. For example, in the above, inductor cores presenting a square cross section perpendicular to the first axis have been disclosed. However, the inventive concept is not limited to this geometry. For example, the inductor core and/or inductor winding may present an oval, triangular, square or polygonal cross section. Even though the inductor winding disclosed above and in the drawings is having only four sections extending at least partly along the first axis, then it is evident that it is possible within the scope of the invention to suggest inductor windings having more such sections.

In device claims specifying several means, several of these means can be embodied by one and the same structural component. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An inductor comprising an inductor core having a higher magnetic permeability than air, and an inductor winding comprising at least one conductor wound in one or more loops, where the inductor core at least partly extends along a first axis, and the inductor winding extends completely around the first axis of the inductor core in such a way that the inductor winding has a number of discrete positions or first sections where it extends in a direction being perpendicular to the first axis of the inductor core, and wherein the inductor winding between the discrete positions or sections has second sections where the inductor winding extends at least partly along the first axis, wherein the inductor core comprises a first and a second inductor core part, each having a first number of abutment surfaces being arranged substantially parallel to the first axis, and a second number of abutment surfaces being arranged transverse to the first axis, and where the first number of abutment surfaces on the first and the second inductor core part are complementarily shaped, so that the inductor core parts can be assembled by sliding the first number of abutment surfaces of the first inductor core part on the first number of abutment surfaces on the second inductor core part, and along the first axis, until the second number of abutment surfaces on the first inductor part abuts the abutment surfaces on the second inductor part.

2. An inductor according to claim 1, wherein the inductor winding, at least at one discrete position or section of each second section, extends in a direction being parallel to the first axis of the inductor core.

3. An inductor according to claim 1, wherein the inductor core surrounds the inductor winding at least along a section of one or more of the second sections.

4. An inductor according to claim 3, wherein the inductor core completely encapsulates the inductor winding.

5. An inductor according to claim 1, wherein when the second number of abutment surfaces on the first inductor part abuts the abutment surfaces on the second inductor part, the two inductor core parts form a channel for enclosing at least the second sections of the inductor winding.

6. An inductor comprising an inductor core having a higher magnetic permeability than air, and an inductor winding comprising at least one conductor wound in one or more loops, where the inductor core at least partly extends along a first axis, the one or more loops being u-shaped so that each loop has two legs extending from a base portion of the u-shape and the two legs extend in a direction parallel with the first axis, and the inductor winding extends completely around the first axis of the inductor core in such a way that the inductor winding has a number of discrete positions or first sections where it extends in a direction being perpendicular to the first axis of the inductor core, and wherein the inductor winding between the discrete positions or first sections has one of the legs extending in the direction parallel with the first axis, wherein the inductor core surrounds the inductor winding at least along a section of one or more of the legs.

7. An inductor according to claim 6, wherein the inductor core completely encapsulates the inductor winding.

8. An inductor according to claim 6, wherein the inductor core comprises a first and a second inductor core part, each having a first number of abutment surfaces being arranged substantially parallel to the first axis, and a second number of abutment surfaces being arranged transverse to the first axis, and where the first number of abutment surfaces on the first and the second inductor core part are complementarily shaped, so that the inductor core parts can be assembled by sliding the first number of abutment surfaces of the first inductor core part on the first number of abutment surfaces on the second inductor core part, and along the first axis, until the second number of abutment surfaces on the first inductor part abuts the abutment surfaces on the second inductor part, in which mutual position the two inductor core parts forms a channel for enclosing at least the two legs of the inductor winding.

9. An inductor according to claim 1, wherein the two inductor core parts comprise surface-insulating soft magnetic powder.

10. An inductor according to claim 1, wherein the two inductor core parts comprise soft magnetic powder wherein the soft magnetic powder comprises at least one element selected from the group consisting of iron, nickel, and cobalt, and wherein the soft magnetic powder further comprises electrical insulation comprising an inorganic material.

11. An inductor according to claim 1, wherein the two inductor core parts comprise soft magnetic powder with a weight average particle size of about 10 μm to about 300 μm.

12. An inductor according to claim 1, wherein the two inductor cores have a symmetrical cross section perpendicular to the first axis, wherein the symmetrical cross section is selected from the group consisting of an oval cross section, a triangular cross section, a square cross section, and a polygonal cross section.

* * * * *